United States Patent [19]

Amis et al.

[11] Patent Number: 5,006,697

[45] Date of Patent: Apr. 9, 1991

[54] SEQUENTIAL SEAL

[75] Inventors: Lynn F. Amis, Valley; Daniel R. Gee, Lincoln, both of Nebr.

[73] Assignee: Convoy Security Company, Omaha, Nebr.

[21] Appl. No.: 467,492

[22] Filed: Jan. 19, 1990

[51] Int. Cl.[5] ..... G06M 1/08; G06M 1/276

[52] U.S. Cl. ..... 235/91 R

[58] Field of Search ..... 235/91 R, 53, 99 A, 235/99 R, 123, 117 R, 127; 70/436; 116/306–309, 317, 318

[56] References Cited

U.S. PATENT DOCUMENTS

| | | | |
|---|---|---|---|
| 827,177 | 7/1906 | Pixley | 70/436 |
| 1,465,136 | 8/1923 | Klein | 70/436 |
| 1,590,046 | 6/1926 | Man et al. | 70/436 |
| 1,699,190 | 1/1929 | Hoffman | 70/436 |
| 3,040,556 | 6/1962 | Rosenhagen | 70/315 |
| 3,751,718 | 8/1973 | Hanchett, Jr. | 317/134 |
| 3,831,065 | 8/1974 | Martin et al. | 317/134 |
| 3,876,913 | 4/1975 | Perry | 317/134 |
| 3,885,408 | 5/1975 | Clark, Jr. | 70/278 |
| 3,893,722 | 7/1975 | Galbreath et al. | 292/100 |
| 4,094,175 | 6/1978 | Pechner | 70/364 A |
| 4,161,870 | 7/1979 | Barnes | 70/278 |
| 4,324,426 | 4/1982 | Michelson | 292/281 |
| 4,372,136 | 2/1983 | Mickelson | 70/14 |
| 4,389,862 | 6/1983 | Hastings | 70/2 |
| 4,534,194 | 8/1985 | Aydin | 70/278 |
| 4,627,248 | 12/1986 | Haworth | 70/134 |
| 4,637,237 | 1/1987 | Witkoski et al. | 70/285 |

FOREIGN PATENT DOCUMENTS

| | | | |
|---|---|---|---|
| 245726 | 3/1926 | Italy | 70/285 |

OTHER PUBLICATIONS

Official Gazette 8/4/87, p. 57, Eberhard Advertising Literature.

Security Transport, Inc., Advertising Brochure Encrypta Electronics, Ltd., Advertising Literature.

*Primary Examiner*—L. T. Hix

*Assistant Examiner*—Eddie Lee

*Attorney, Agent, or Firm*—Zarley, McKee, Thomte, Voorhees & Sease

[57] ABSTRACT

A sequential seal for use with a roll-up door positioned in a truck or van body and which indicates the number of times that the door has been moved from its closed position towards its open position. A sequential counter is mounted in the door and is actuated each time the door is moved from its closed position towards its open position.

2 Claims, 4 Drawing Sheets

SEQUENTIAL SEAL

BACKGROUND OF THE INVENTION

This invention relates to a sequential seal for use in connection with a roll-up door on a truck so that it may be determined when the roll-up door has been opened.

Roll-up doors have long been used on truck bodies or the like. Generally speaking, the roll-up doors comprise a plurality of horizontally disposed panels or sections which are hingedly secured to one another and which may be vertically moved to either close or open the opening in which it is mounted. The vast majority of conventional roll-up doors includes some sort of locking handle assembly mounted at the exterior surface of the lowermost panel designed to prevent the opening of the door when in its locked position. In some cases, a padlock is used to maintain the locking handle assembly in its locked position.

In most cases, flexible seals are utilized to indicate whether the door has been opened. Although the use of flexible seals is generally satisfactory, they do possess some disadvantages. For example, the constant replacement of seals is costly. Yet another disadvantage of the conventional flexible seal system is that once the seal has been broken, the door may be opened and closed many times without the owner of the truck having any record as to the number of times the door has been opened and closed which therefore leads to the possibility of unauthorized deliveries, etc.

It is therefore a principal object of the invention to provide a sequential seal for use with a roll-up door.

Yet another object of the invention is to provide a sequential seal including a counter means which indicates the number of times that the door has been opened.

Yet another object of the invention is to provide a sequential seal for use with a roll-up door which is convenient to use.

Still another object of the invention is to provide a sequential seal for use with a roll-up door which is economical of manufacture, durable in use and refined in appearance.

These and other objects of the present invention will be apparent to those skilled in the art.

SUMMARY OF THE INVENTION

Figure 1:
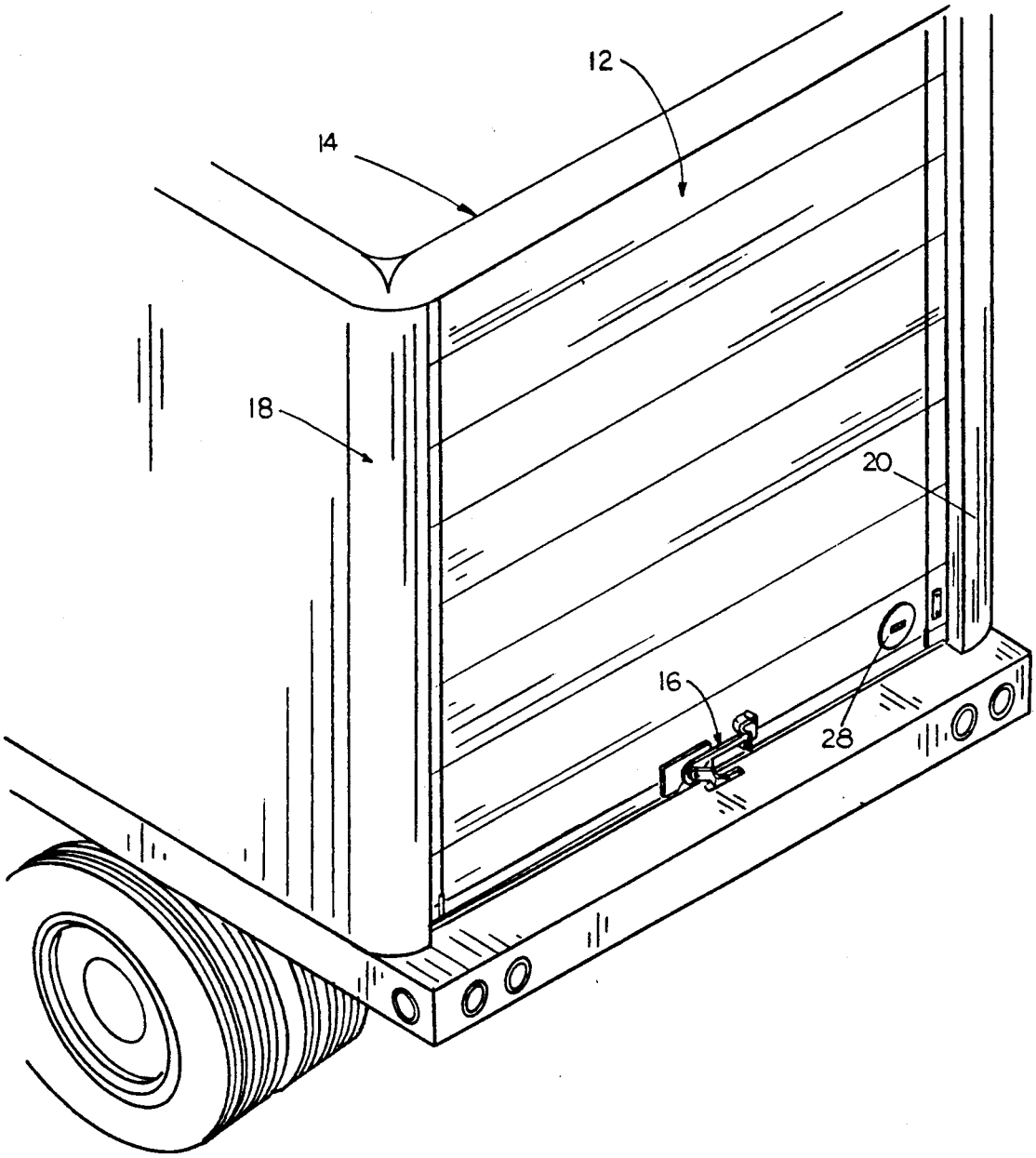
FIG. 1 is a rear perspective view of a truck body having a roll-up door mounted therein in which the sequential seal of this invention is mounted.

A sequential seal is described for use in combination with a roll-up door mounted on a truck or the like. The sequential seal includes a counter means which is actuated each time the door is moved from its closed position to its open position. When the sequential seal is mounted on a truck, the counter means associated therewith indicates the number of times that the door has been moved from its closed to open position so that the owner of the truck may determine if the door has been opened a greater number of times than the authorized number.

DESCRIPTION OF THE PREFERRED EMBODIMENT

The sequential seal of this invention is referred to generally by the reference numeral 10 and is designed to be utilized with a roll-up door 12 mounted on a van or truck body 14. The numeral 16 refers to the conventional locking assembly normally utilized on the door 12. Door 12 is mounted in a conventional door jam 18 including a vertically disposed frame member 20. Positioned within the frame member 20 and secured thereto is a stationary trip lever 22 including a rearwardly extending pin 24.

An interior housing 26 is secured to the inside surface of the door 12 and has a counter display portion 28 protruding through the door so as to be visible from the rear of the door as viewed in FIG. 1. Counter 28 is conventional is design and records and indicates the number of times the door has been moved from its closed position towards its open position. Counter 28 includes a laterally extending actuator 30 which, when actuated, causes the counter to advance one digit.

Figure 2:
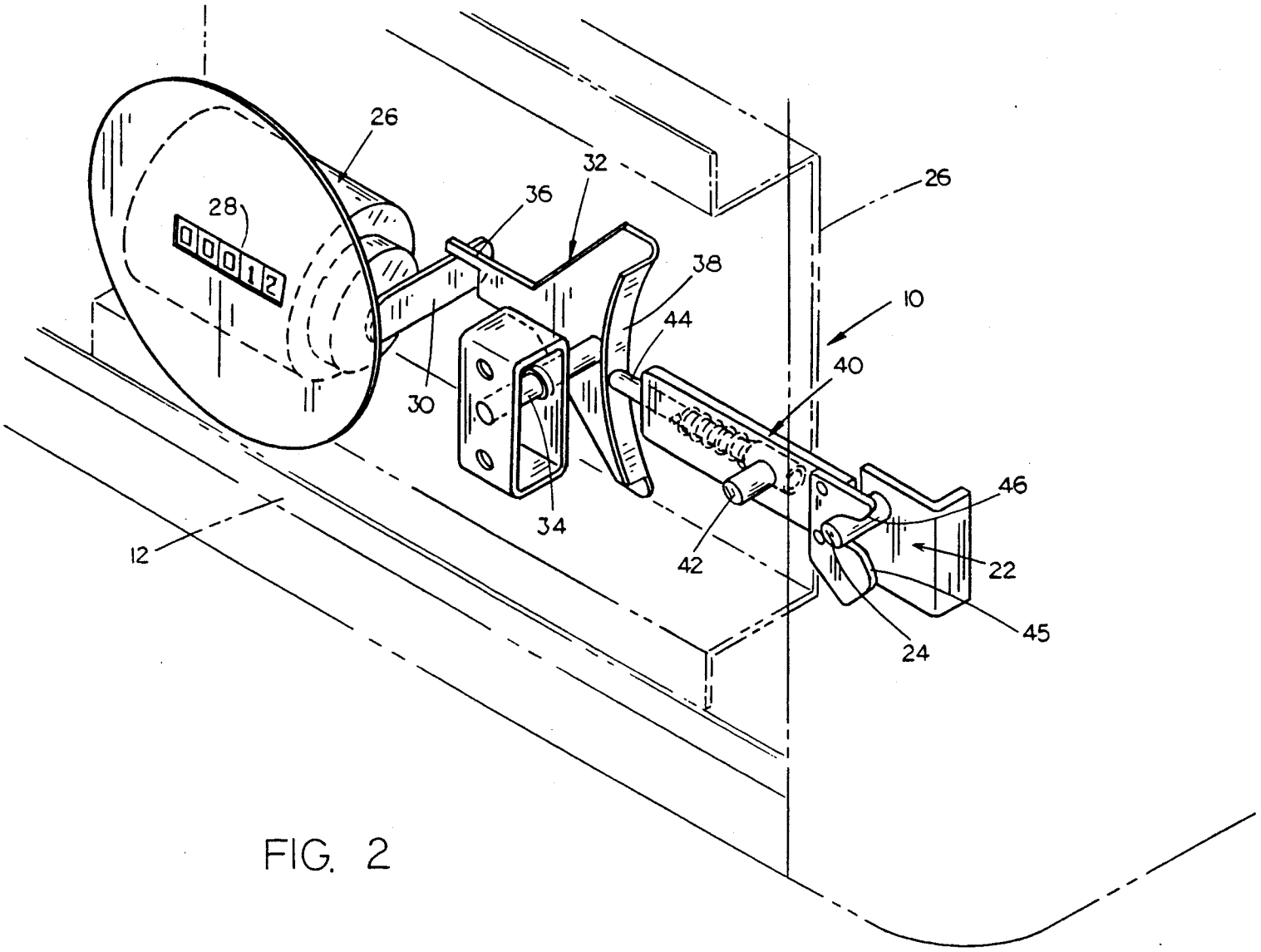
FIG. 2 is a perspective view of the sequential seal of this invention.

The numeral 32 refers to a counter driver lever pivotally mounted in the door about a horizontal axis generally referred to by the reference numeral 34. Counter driver lever 32 has an arm 36 extending inwardly therefrom which is adapted to engage the actuator 30 when the counter driver lever 32 is pivoted from the position of FIG. 4 to the position illustrated in FIG. 3. Counter driver lever has an arcuate cam surface 38 at its inner end as best seen in FIG. 2.

The numeral 40 designates a trip driven lever which is pivotally mounted in the door about a horizontal axis generally referred to by the reference numeral 42. A spring-loaded pin 44 protrudes inwardly from the trip driven lever 40 and is designed to engage the cam surface 38 as seen in the drawings. The outer end of trip driven lever 40 is provided with cam surfaces 45 and 46 which communicate with a slot 48 formed in the outer end thereof.

Figure 5:
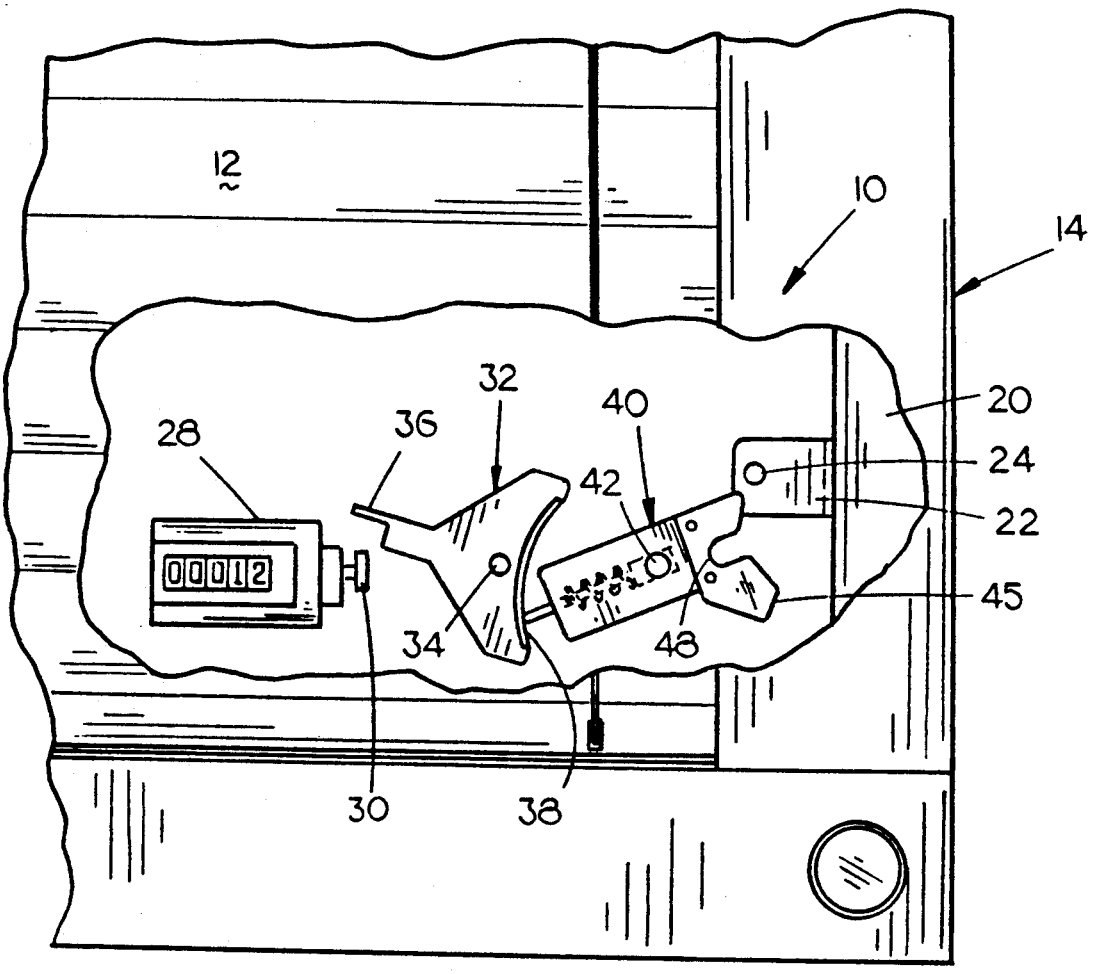
FIG. 5 is a view similar to FIGS. 3 and 4 except that the roll-up door is illustrated in its closed position.

When the door 12 is in its lowermost or closed position, counter driver lever 32 is in the position illustrated in FIG. 5. When the door 12 is moved towards its upper or open position from the position of FIG. 5, pin 24 is initially received by opening 48. Continued upward movement of the door causes the trip driven lever 40 to be pivotally rotated about axis 42 in a clockwise direction as viewed in FIG. 3. As the trip driven lever 40 rotates clockwise about axis 42, the inner end of pin 44 moves upwardly on the cam surface 38 until the inner end of the pin 44 is above the axis defined by the pin 34. When pin 44 passes axis 34, counter driver lever 32 is pivoted in a counter-clockwise direction, as viewed in FIG. 3, which causes the arm 36 to engage the actuator 30 thereby advancing the counter 28 one digit. The counter 28 is advanced even though the door is not open to its completely open position.

Figure 3:
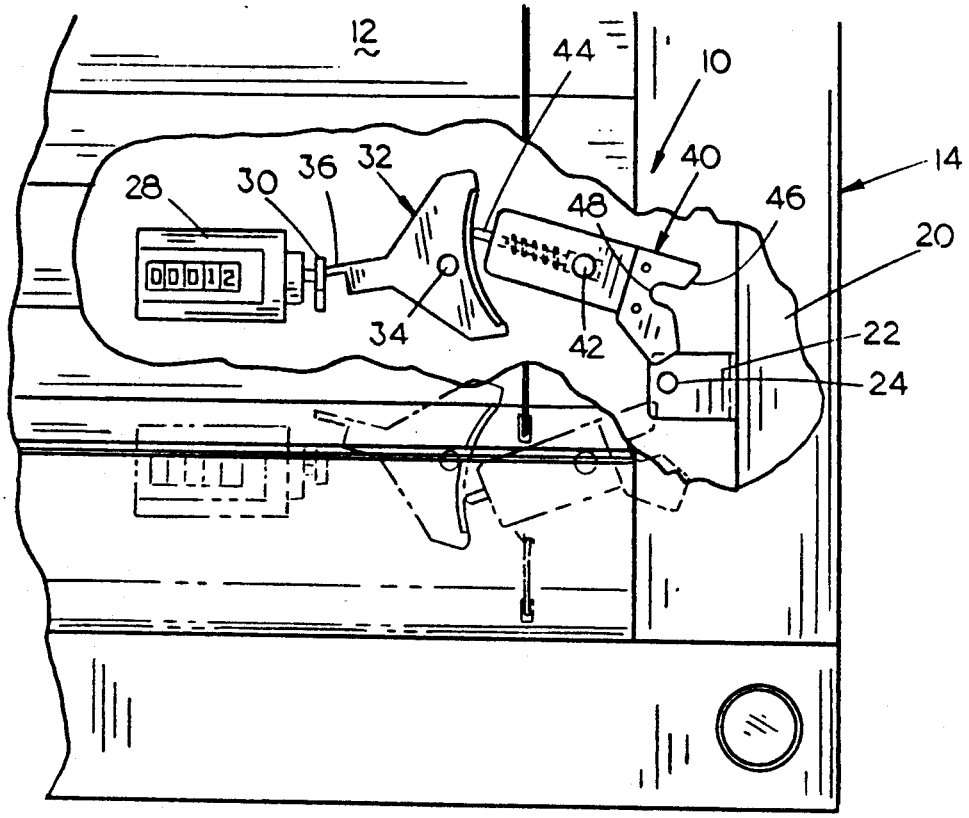
FIG. 3 is rear view of the sequential seal of this invention which illustrates the roll-up door having been moved to a partially open position.
Figure 4:
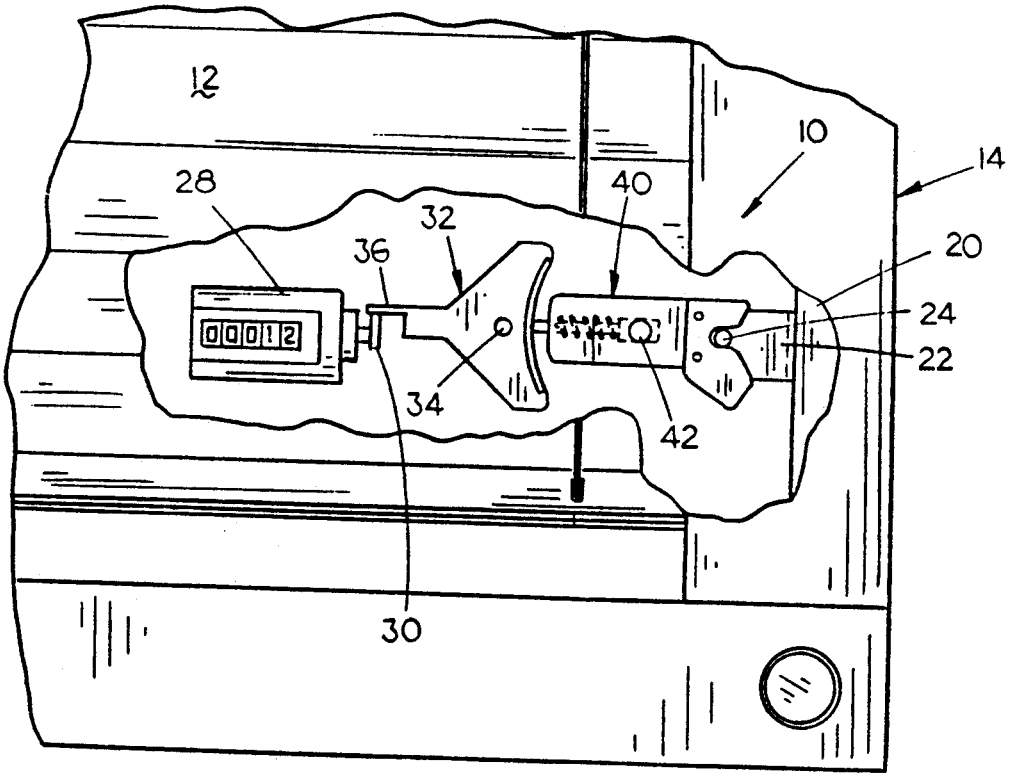
FIG. 4 is a view similar to that of FIG. 3 except that the roll-up door has been lowered somewhat.

When the door is moved to its closed position, cam surface 45 engages pin 24, to position pin 24 in opening 48 and to cause the trip driven lever 40 to pivot from the position illustrated in FIG. 3, to the position illustrated in FIG. 4 so that the trip driven lever 40 pivots in a counterclockwise direction about axis 42. The counterclockwise pivotal movement of the trip driven lever 40 causes the counter driver lever 32 to pivotally move in a clockwise direction which causes the arm 36 to move out of engagement with the actuator 30.

The design of the outer end of the trip driven lever 40 is quite important in that the cooperation of the cam surfaces 45 and 46 with the slot 48 prevents the trip driven lever 40 from being pivoted to a position wherein the trip driven lever 40 would be jammed or in the wrong position to be moved from its closed to open positions or vice versa.

The sequential seal of this invention enables the owner of the truck to ascertain the number of times that the door 12 has been opened for any given period of time. Thus, if the owner of the truck knows that the driver of the truck is supposed to only make two authorized stops, the sequential seal counter will indicate whether the door has been opened a greater number of times than the authorized number so that the owner of the truck will be alerted to the fact that perhaps unauthorized stops and deliveries have been made by the truck driver.

Thus it can be seen that the invention accomplishes at least all of its stated objectives.

I claim:

1. In combination, a van body having a door opening formed therein defined by at least one vertically disposed door frame member, a roll-up door selectively vertically movably mounted in said door opening and movable between open and closed positions, and a sequential seal means operatively associated with said door, said seal means including indicator means for indicating the number of times said door has been moved from said closed position towards said open position, said sequential seal means comprising a counter means mounted on said door and having a counter actuator extending therefrom, a spring loaded counter driver lever pivotally mounted, about a horizontal axis, in said door and movable between first and second positions, said counter drive level having inner and outer ends, said counter driver lever arm extending therefrom at the inner end thereof adapted to engage said counter actuator when said counter driver lever is moved from said first position to said second position, said counter drive lever normally being in said first position when said door is in said closed position and in said second position when said door has been moved to said open position, said counter drive lever having an arcuate cam surface at said outer end thereof, a trip driven lever pivotally mounted, about a horizontal axis, on said door outwardly of said counter driver lever and having inner and outer ends, said trip driven lever having a spring-loaded pin means mounted thereon extending from the inner end thereof which is in engagement with said arcuate cam surface, said trip driven lever being movable between first and second positions, said trip driven lever normally being in said first position to position said counter driver lever in said first position, said spring-loaded pin causing said counter driver lever to pivot to said second position when said trip driven lever is moved to said second position, said outer end of said trip driven lever having a trip lever pin receiving opening formed therein, and a trip lever pin mounted in said door frame member.

2. The combination of claim 1 wherein said outer end of said trip driven lever has a first cam surface extending upwardly and outwardly from said trip lever pin receiving opening and has a second cam surface extending outwardly and downwardly from said trip lever pin receiving opening.

* * * * *